US009266345B2

(12) United States Patent
Kimura et al.

(10) Patent No.: US 9,266,345 B2
(45) Date of Patent: Feb. 23, 2016

(54) LIQUID DISCHARGE HEAD AND IMAGE FORMING APPARATUS

(71) Applicants: Yu Kimura, Kanagawa (JP); Kenichiro Hashimoto, Kanagawa (JP)

(72) Inventors: Yu Kimura, Kanagawa (JP); Kenichiro Hashimoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 194 days.

(21) Appl. No.: 13/711,931

(22) Filed: Dec. 12, 2012

(65) Prior Publication Data

US 2013/0147887 A1 Jun. 13, 2013

(30) Foreign Application Priority Data

Dec. 13, 2011 (JP) ..... 2011-272044
Oct. 10, 2012 (JP) ..... 2012-224742

(51) Int. Cl.

| | |
|---|---|
| ***B41J 2/175*** | (2006.01) |
| ***B41J 2/17*** | (2006.01) |
| ***B41J 2/20*** | (2006.01) |
| ***B41J 2/055*** | (2006.01) |
| ***B41J 2/14*** | (2006.01) |

(52) U.S. Cl.

CPC .. *B41J 2/20* (2013.01); *B41J 2/055* (2013.01); *B41J 2/14274* (2013.01); *B41J 2/17563* (2013.01)

(58) Field of Classification Search

USPC ..... 347/93, 84–87, 92, 94, 68, 71
See application file for complete search history.

(56) References Cited

U.S. PATENT DOCUMENTS

| | | | | |
|---|---|---|---|---|
| 5,030,973 | A * | 7/1991 | Nonoyama et al. | 347/93 |
| 6,367,914 | B1 | 4/2002 | Ohtaka et al. | |
| 6,682,185 | B2 | 1/2004 | Hashimoto et al. | |
| 6,685,299 | B2 | 2/2004 | Hirota | |
| 6,692,109 | B2 * | 2/2004 | Hirota et al. | 347/54 |
| 6,913,348 | B2 | 7/2005 | Hashimoto et al. | |
| 7,090,325 | B2 | 8/2006 | Hashimoto et al. | |
| 7,364,253 | B2 | 4/2008 | Hashimoto et al. | |
| 7,364,285 | B2 * | 4/2008 | Murad et al. | 347/94 |
| 7,370,940 | B2 | 5/2008 | Hashimoto | |
| 7,416,281 | B2 | 8/2008 | Nishimura et al. | |
| 7,530,677 | B2 * | 5/2009 | Chikamoto | 347/71 |
| 7,635,176 | B2 * | 12/2009 | Taira et al. | 347/20 |
| 7,665,830 | B2 | 2/2010 | Hashimoto et al. | |
| 7,731,861 | B2 | 6/2010 | Hashimoto et al. | |

(Continued)

FOREIGN PATENT DOCUMENTS

| | | | |
|---|---|---|---|
| EP | 383558 | A1 * | 8/1990 |
| EP | 1336487 | A2 * | 8/2003 |

(Continued)

OTHER PUBLICATIONS

Machine Translation for Kamito (JP Pat 2006231812 A).*

*Primary Examiner* — Julian Huffman
*Assistant Examiner* — Leonard S Liang
(74) *Attorney, Agent, or Firm* — Cooper & Dunham LLP

(57) ABSTRACT

A liquid discharge head includes a nozzle that discharges liquid droplets, a common liquid chamber that supplies liquid to an individual liquid chamber that is in communication with the nozzle, and a filter plate that is arranged in a liquid flow path of the common liquid chamber. The filter plate includes a filter part that filters the liquid and a damper part that reduces a pressure variation in the common liquid chamber, and the filter part is arranged to be thicker than the damper part.

8 Claims, 21 Drawing Sheets

(56) References Cited

U.S. PATENT DOCUMENTS

| | | | | |
|---|---|---|---|---|
| 7,764,006 | B2 | 7/2010 | Tsukamura et al. | |
| 7,775,652 | B2 * | 8/2010 | Taira et al. | 347/93 |
| 7,824,518 | B2 * | 11/2010 | Nakashima et al. | 156/307.1 |
| 8,047,637 | B2 | 11/2011 | Tsukamura et al. | |
| 8,052,249 | B2 | 11/2011 | Nishimura et al. | |
| 8,118,413 | B2 | 2/2012 | Hashimoto | |
| 8,182,070 | B2 | 5/2012 | Hashimoto | |
| 8,197,048 | B2 * | 6/2012 | Yamanaka et al. | 347/94 |
| 2002/0196315 | A1 * | 12/2002 | Isono et al. | 347/71 |
| 2003/0156159 | A1 * | 8/2003 | Kobayashi | 347/54 |
| 2003/0156162 | A1 * | 8/2003 | Hirota et al. | 347/66 |
| 2004/0056937 | A1 * | 3/2004 | Ito | 347/93 |
| 2005/0231561 | A1 | 10/2005 | Hashimoto | |
| 2006/0061634 | A1 * | 3/2006 | Hori | 347/71 |
| 2009/0179978 | A1 * | 7/2009 | Brown et al. | 347/94 |
| 2010/0053269 | A1 | 3/2010 | Fujii et al. | |
| 2010/0134571 | A1 * | 6/2010 | Shimizu | 347/85 |
| 2010/0328409 | A1 | 12/2010 | Matsufuji et al. | |

FOREIGN PATENT DOCUMENTS

| | | | |
|---|---|---|---|
| JP | 03205157 | A * | 9/1991 |
| JP | 2002-355961 | | 12/2002 |
| JP | 2002-355962 | | 12/2002 |
| JP | 2003154679 | A * | 5/2003 |
| JP | 2003-311952 | | 11/2003 |
| JP | 2006-231812 | | 9/2006 |
| JP | 2006231812 | A * | 9/2006 |
| JP | 2006305988 | A * | 11/2006 |
| JP | 2011/25663 | | 2/2011 |

* cited by examiner

LIQUID DISCHARGE HEAD AND IMAGE FORMING APPARATUS

BACKGROUND OF THE INVENTION

1. Field of the Invention

The disclosures herein generally relate to a liquid discharge head and an image forming apparatus including the liquid discharge head.

2. Description of the Related Art

An image forming apparatus of a printer, a facsimile machine, a copier, a plotter, or a multifunction peripheral (MFP) combining one or more of the above functions may be realized by an inkjet recording apparatus, which is a liquid discharge type image forming apparatus that uses a recording head made of a liquid discharge head (liquid droplet discharge head) that discharges liquid droplets, for example.

The liquid discharge type image forming apparatus forms (records or prints) an image by discharging ink droplets from the recording head onto a recording medium (paper sheet, OHP film, etc.) that is being transported. The image forming apparatus may be a serial-type image forming apparatus in which the recording head discharges liquid droplets while moving in the main scanning direction or a line-type image forming apparatus that uses a line-type recording head that discharges liquid droplets without moving.

The liquid discharge head supplies ink from an ink tank via a common liquid chamber to plural individual liquid chambers (e.g., pressure chamber, individual supply paths), and selectively applies pressure to the ink supplied to the individual liquid chambers to prompt liquid droplets to be discharged from a nozzle.

A nozzle hole of the liquid discharge head is typically arranged to be around several tens of micrometers (μm) in diameter. Thus, when some foreign particle gets mixed with the ink, the foreign particle may flow with the ink and get stuck in the nozzle to thereby cause a discharge defect.

In order to prevent clogging of the nozzle by such foreign particles, a filter for removing foreign particles and air bubbles is arranged at an ink supply path for supplying ink to the nozzle. Also, a damper for absorbing pressure variations is arranged in the common liquid chamber in order to prevent the transmission of pressure variations after discharging ink.

Various techniques are disclosed for arranging the filter and the damper on the same member (e.g., see Japanese Laid-Open Patent Publication Nos. 2003-311952, 2006-231812, and 2011-25663). By arranging the filter and the damper on the same member, fabrication processes may be simplified, for example.

Japanese Laid-Open Patent Publication No. 2003-311952 discloses an inkjet head that has a damper for absorbing pressure variations in a common ink chamber and a trap filter having fine through holes arranged on the same plate. Japanese Laid-Open Patent Publication No. 2006-231812 discloses a recording head that has a filter integrally formed with a damper arranged between a common liquid chamber and individual liquid chambers. Japanese Laid-Open Patent Publication No. 2011-25663 discloses a liquid injection head that has a damper and a filer section formed on a first layer of a vibrating plate member that forms a part of the walls of individual liquid chambers.

Conventionally, a filter needs to have high stiffness in order to prevent the filter from breaking. On the other hand, since a damper absorbs pressure variations, it needs to have high compliance, which is the inverse of stiffness and is an indicator of elasticity and flexibility.

Even in the case of forming a filter and a damper on the same member, the filter needs to have high stiffness and the damper needs to have high compliance.

However, the above disclosures do not contemplate arranging the filter to have high stiffness and arranging the damper to have high compliance in forming the filter and the damper on the same member. Thus, when the damper is arranged to have adequately high compliance for achieving desired performance, the stiffness of the filter may be inadequate, and the filter may be prone to breaking.

SUMMARY OF THE INVENTION

It is a general object of at least one embodiment of the present invention to provide a liquid discharge head that substantially obviates one or more problems caused by the limitations and disadvantages of the related art.

In one embodiment, a liquid discharge head includes a nozzle that discharges liquid droplets, a common liquid chamber that supplies liquid to an individual liquid chamber that is in communication with the nozzle, and a filter plate that is arranged in a liquid flow path of the common liquid chamber. The filter plate includes a filter part that filters the liquid and a damper part that reduces a pressure variation in the common liquid chamber, and the filter part is arranged to be thicker than the damper part.

According to an aspect of the present invention, a liquid discharge head may have a filter part with adequately high stiffness and a damper with adequately high compliance arranged on the same member so that stable liquid discharge performance may be maintained and high productivity may be achieved, for example.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments of the present invention are described with reference to the accompanying drawings.

Figure 1A:
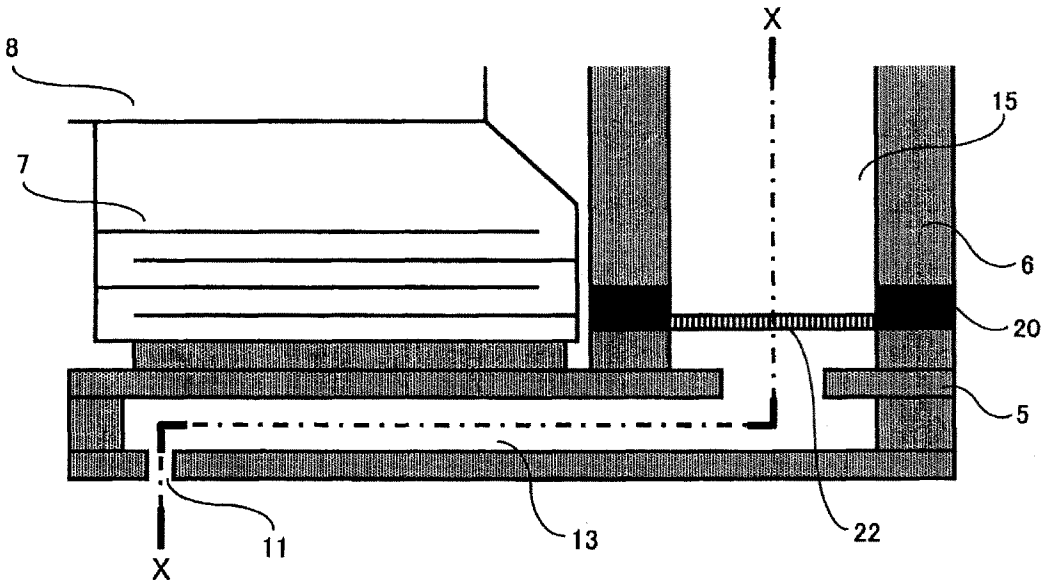
FIGS. 1A-1B are cross-sectional views of a liquid discharge head according to an embodiment of the present invention.
Figure 1B:
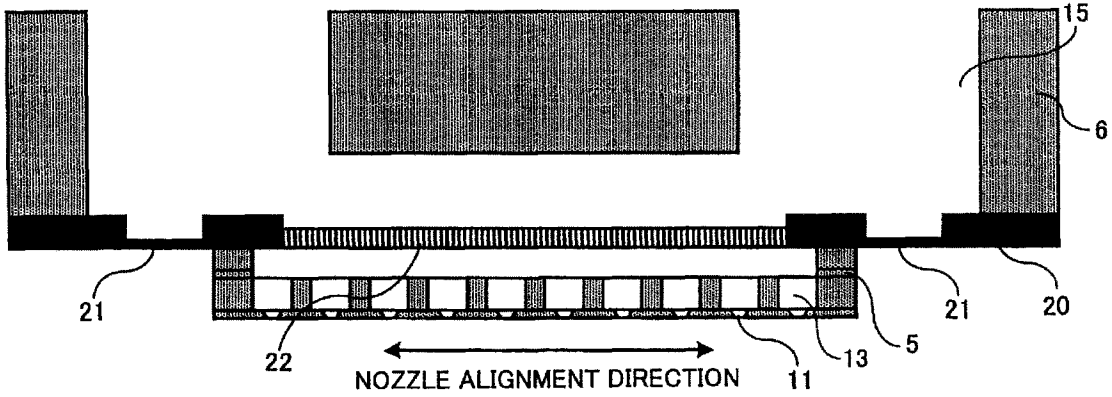

FIG. 1A is a partial cross-sectional view of a liquid discharge head according to an embodiment of the present invention, and FIG. 1B is a cross-sectional view of section X-X of FIG. 1A.

The liquid discharge head according to the present embodiment includes plural nozzles 11 that discharge liquid droplets, plural individual liquid chambers (pressurized liquid chambers) 13 that are in communication with the nozzles 11, a common liquid chamber 15 that supplies liquid to the individual liquid chambers 13, and a filter plate 20 that is arranged in a liquid flow path of the common liquid chamber 15. The filter plate 20 include a filter part (internal filter) 22 for filtering the liquid and a damper part 21 for reducing pressure variations in the common liquid chamber 15 formed thereon, and the filter part 22 is arranged to be thicker than the damper part 21. The liquid discharge head also includes an oscillating plate 5, a frame 6, a piezoelectric element 7, and a base member 8, which are described below.

Figure 2A:
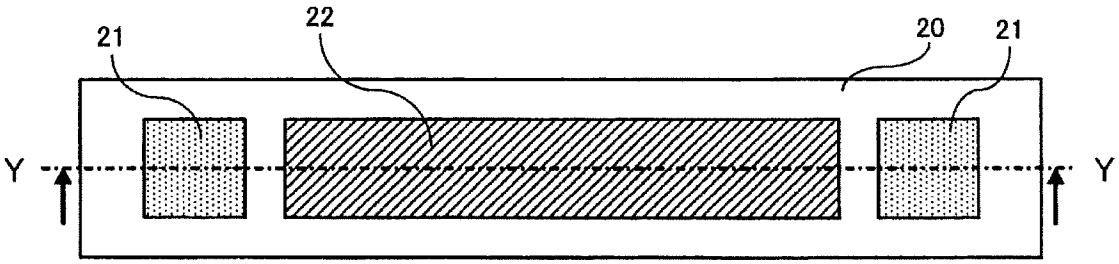
FIGS. 2A-2B are a top view and a cross-sectional view of a filter plate.
Figure 2B:
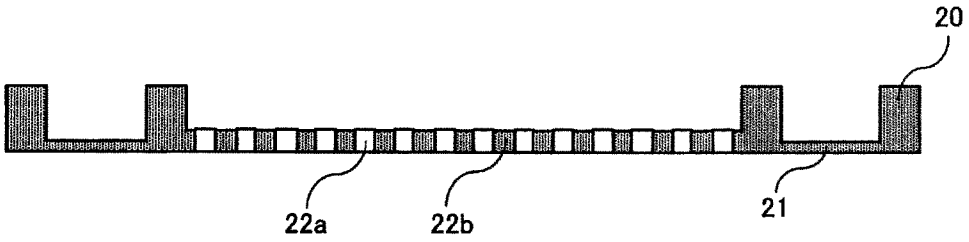

FIG. 2A is a top view of the filter plate 20, and FIG. 2B is a cross-sectional view of section Y-Y of FIG. 2A.

As is shown in FIG. 2A, the filter part 22 and the damper part 21 are both arranged on the filter plate 20. As is shown in FIG. 2B, the filter part 22 includes plural filter holes 22*a* and a filter member 22*b*. Since the filter part 22 and the damper part 21 are both arranged on the filter plate 20, they are positioned on the same horizontal plane at the same height.

The filter plate 20 is a rectangular plate with long sides extending in the nozzle alignment direction and short sides extending in the direction perpendicular to the nozzle alignment direction, and the damper part 21 and the filter part 22 are integrally formed on the filter plate 20.

The filter part 22 is arranged into a rectangular shape with long sides extending across substantially the entire length of the individual liquid chambers in the nozzle alignment direction.

The damper part 21 is arranged at the two sides of the filter part 22 in the nozzle alignment direction. By aligning the damper part 21 and the filter part 22 in the nozzle alignment direction on the rectangular filter plate 20 that has long sides extending in the nozzle alignment direction, the damper part 21 may be arranged into a quadrangle shape in planar view with long sides and short sides having substantially the same length. It is noted that the quadrangle shape of the damper part 21 is not limited to a rectangle or a square, but may also be a quadrangle with acute/obtuse angles, a quadrangle with rounded corners, or a quadrangle with non-linear sides such as a barrel shape, for example.

The damper part 21 is configured to reduce the pressure variations created within the common liquid chamber 15 and is arranged to be thinner than the filter part 22.

As is shown in FIG. 2A, in the present embodiment, the damper part 21 is arranged into a substantially square shape with long sides and short sides having substantially the same length. The compliance of the damper part 21 increases in proportion to the fifth power of the short side length and the first power of the long side length. Accordingly, higher compliance may be obtained when the damper part 21 is closer to a square shape, and in turn, the damper part 21 may have greater capacity to reduce pressure variations within the common liquid chamber 15.

Also, by arranging the filter part 22 and the damper part 21 in the nozzle alignment direction, the head width of the liquid recording head (width in the direction perpendicular to the nozzle alignment direction) may be prevented from widening.

FIGS. 3A-3B and FIGS. 4A-4C show exemplary arrangements of the filter part 22 and the damper part 21.

Figure 3A:
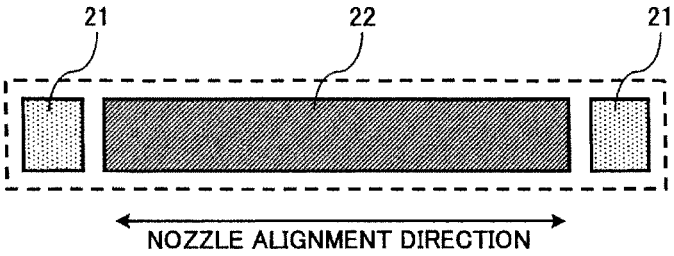
FIGS. 3A-3B show exemplary arrangements of a filter part and a damper part.
Figure 3B:
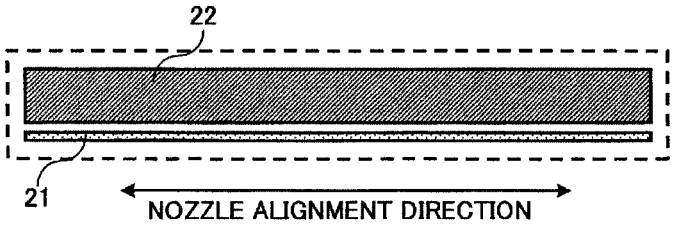

FIG. 3A shows the arrangement of the filter part 22 and the damper part 21 according to the present embodiment. FIG. 3B shows an exemplary arrangement of the filter part 22 and the damper part 21 in a conventional liquid discharge head.

As is shown in FIG. 3A, in the liquid discharge head according to the present embodiment, the filter part 22 and the damper part 21 are aligned in the nozzle alignment direction (lengthwise direction of the rectangular filter plate 20). By aligning the filter part 22 and the damper part 21 in the nozzle alignment direction, the damper part 21 may be arranged closer to a square shape compared to the conventional liquid discharge head shown in FIG. 3B where the filter part 22 and the damper part 21 are aligned in the direction perpendicular to the nozzle alignment direction (width direction of the rectangular filter plate 20).

Since the compliance of the damper part 21 increases in proportion to the fifth power of the short side length and the first power of the long side length of the damper part 21, by arranging the filter part 22 and the damper part 21 in the manner shown in FIG. 3A, the compliance of the damper part 21 may be increased while securing an adequate area for the filter part 22.

Figure 4A:
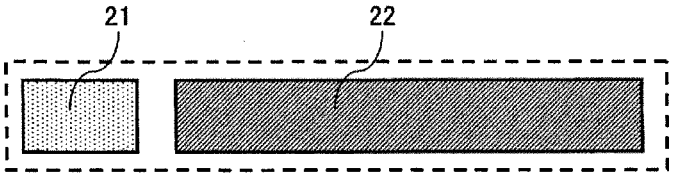
FIGS. 4A-4C show other exemplary arrangements of the filter part and the damper part.
Figure 4B:
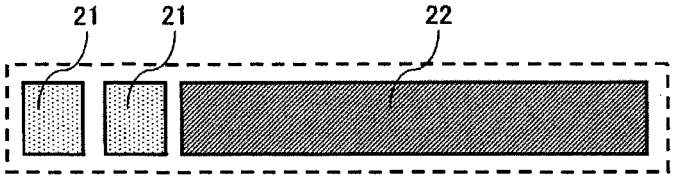
Figure 4C:
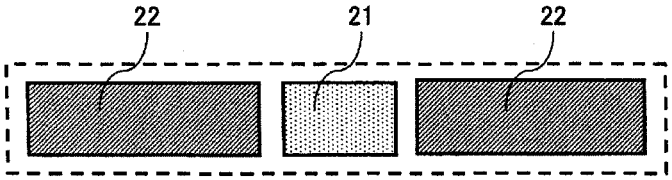

It is noted that the filter part 22 and the damper part 21 may alternatively be arranged in any manner so long as they are aligned in the nozzle alignment direction. For example, the damper part 21 may be arranged at only one side of the filter part 22 as is shown in FIG. 4A, plural damper parts 21 may be arranged at one side of the filter part 22 as is shown in FIG. 4B, or the damper part 21 may be arranged between two filter parts 22.

However, the liquid discharge head preferably has the damper part 21 arranged at both sides of the filter part 22 in the nozzle alignment direction as is shown in FIG. 3A. By arranging the filter part 22 and the damper part 21 in this manner, the amount of resist material used may be reduced while securing adequate stiffness of the filter plate 20.

Also, the planar view shape of the damper part 21 is preferably arranged to be a quadrangle shape with long sides and short sides having substantially the same length. As is described above, the closer the damper part 21 is to a square shape, the higher the compliance of the damper part 21.

Figure 5A:
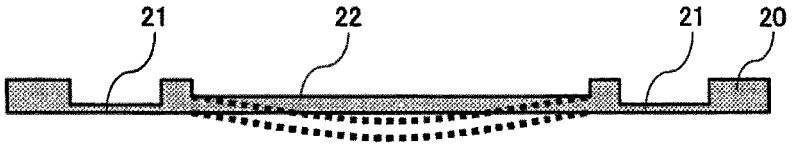
FIGS. 5A-5B show differences in the stiffness of the filter part in relation to its thickness.
Figure 5B:
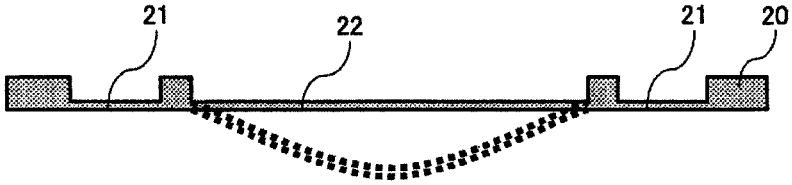

FIGS. 5A-5B illustrate differences in the stiffness of the filter part 22 in relation to its thickness. FIG. 5A shows an exemplary structure of a liquid discharge head according to an embodiment of the present invention where the filter part 22 is arranged to be thicker than the damper part 21. FIG. 5B shows a comparative example in which the filter part 22 and the damper part 21 have the same thickness.

When the filter part 22 and the damper part 21 are aligned in the nozzle alignment direction as described above, the difference in the lengths of the long sides and the short sides of the filter part 22 is reduced as well as the damper part 21. As a result, the compliance of the filter part 22 may be higher compared to the case where the filter part 22 is aligned in the direction perpendicular to the nozzle alignment direction. Thus, if the filter part 22 is arranged to have the same thickness as the damper part 21 as is shown in FIG. 5B, the filter part 22 may be easily deformed and prone to breaking. By arranging the filter part 22 to be thicker than the damper part 21 as is shown in FIG. 5A, adequate stiffness may be secured in the filter part 22.

FIGS. 6A-6G illustrate exemplary process steps for fabricating the filter plate 20 according to an embodiment of the present invention.

Figures 6A, 6B, 6C, 6D:
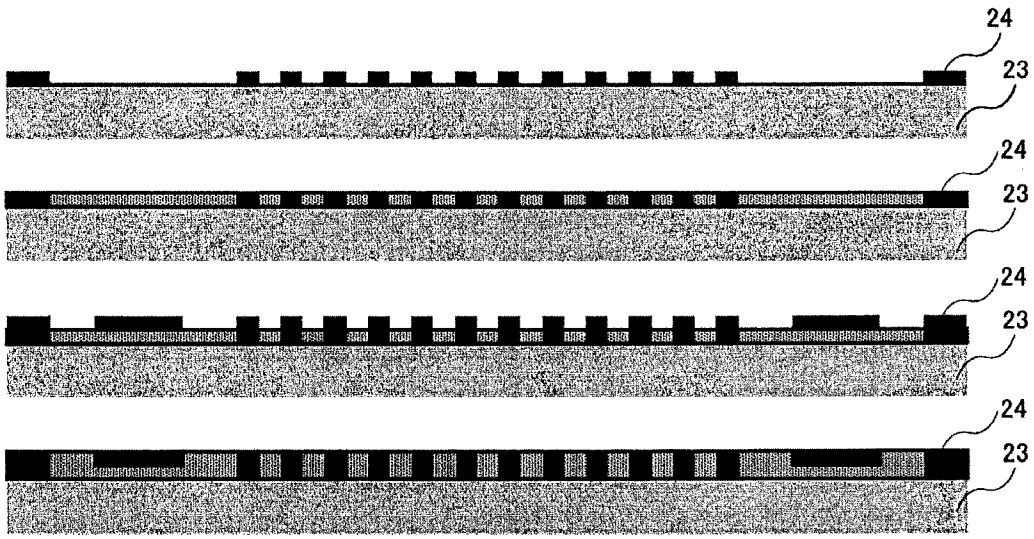
FIGS. 6A-6G show exemplary process steps for fabricating the filter plate.
Figures 6E, 6F, 6G:
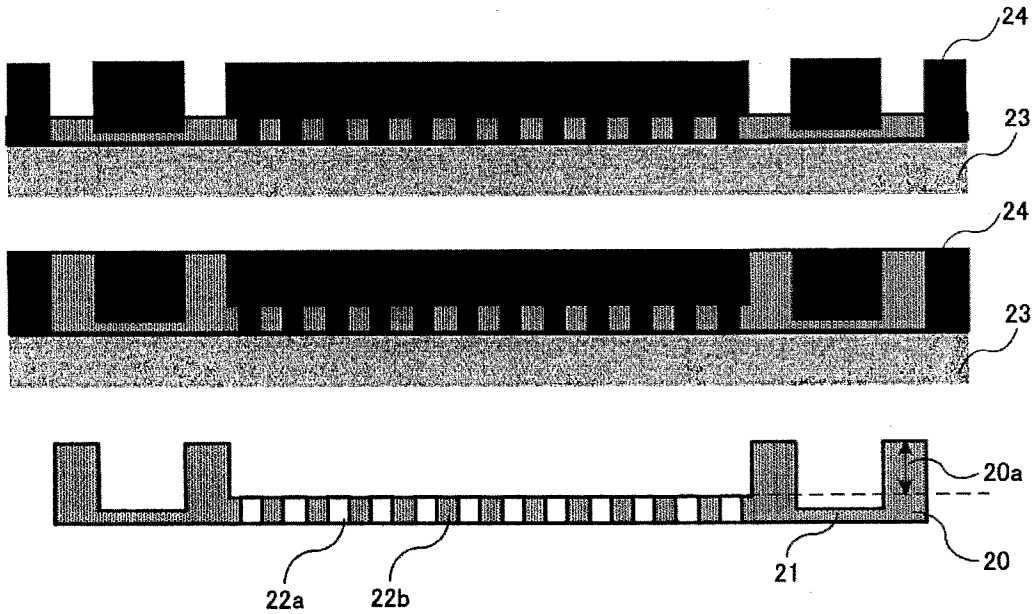

The filter plate 20 as is shown in FIG. 6G may be fabricated by performing electroform processes on a substrate 23 having a resist 24 applied thereon as is shown in FIGS. 6A-6F.

According to the present embodiment, the filter 22 may be arranged to be thicker than the damper part 21 by fabricating the damper part 21 with a first layer that is formed in a first electroforming process (see FIG. 6B), and fabricating the filter part 22 with the first layer formed in the first electroforming process and a second layer that is formed in a second electroforming process (see FIG. 6D). Further, a reinforcing part (or handling part) 20*a* is fabricated with a third layer that is formed in a third electroforming process (see FIGS. 6F-6G).

It is noted that in performing the first electroforming process, since the exposed regions of the substrate 23 where the filter holes 22*a* are to be formed have smaller areas than the exposed regions of the substrate 23 where the damper part 21 is to be formed, the electric field tends to be concentrated in the regions where the filter holes 22*a* are to be formed compared to the regions where the damper part 21 is to be formed. Thus, in the first electroforming process, electroforming material is deposited such that the electroformed layer is slightly thicker at the regions where the filter holes 22*a* are to be formed compared to the regions where the damper part 21 is to be formed. The thicknesses of the filter part 22 and the damper part 21 are subsequently adjusted through multiple electroforming processes to fabricate the filter plate 20 with the filter part 20 having adequate stiffness and the damper part 21 having high compliance.

FIGS. 7A-7D show exemplary shapes and arrangements of the filter holes 22*a* of the filter part 22.

Figure 7A:
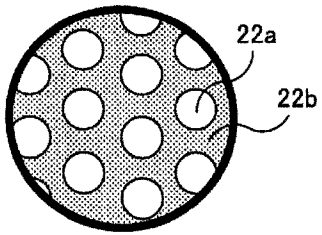
FIGS. 7A-7D show exemplary filter hole arrangements of the filter part.
Figure 7B:
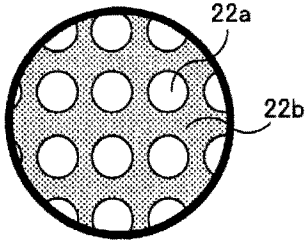
Figure 7C:
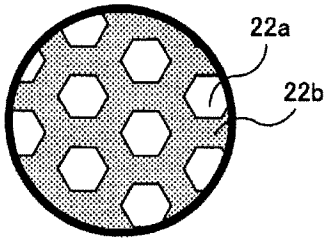
Figure 7D:
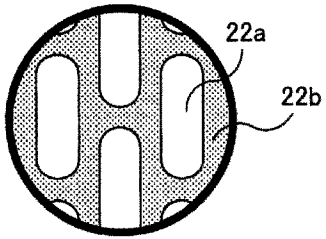

In a preferred embodiment, the filter holes 22*a* are arranged into a honeycomb structure as is shown in FIG. 7A. In an alternative embodiment, the filter holes 22*a* may be arranged into an aligned structure as is shown in FIG. 7B, for example. Also, the shape of the filter holes 22*a* may be arranged into a polygon as is shown in FIG. 7C or an oval as is shown in FIG. 7D, for example.

FIGS. 8A-8G show exemplary process steps for fabricating the filter plate 20 according to another embodiment.

Figures 8A, 8B, 8C, 8D:
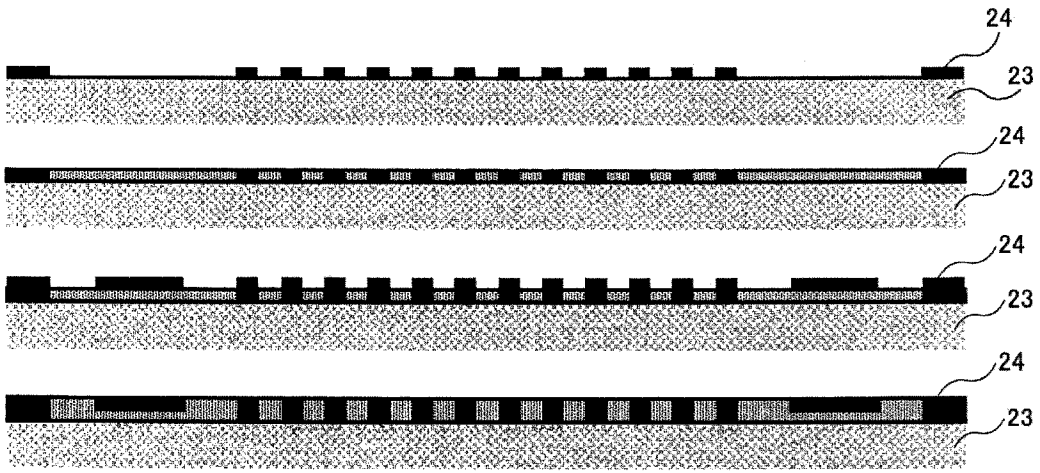
FIGS. 8A-8G show exemplary process steps for fabricating the filter plate according to another embodiment.
Figures 8E, 8F, 8G:
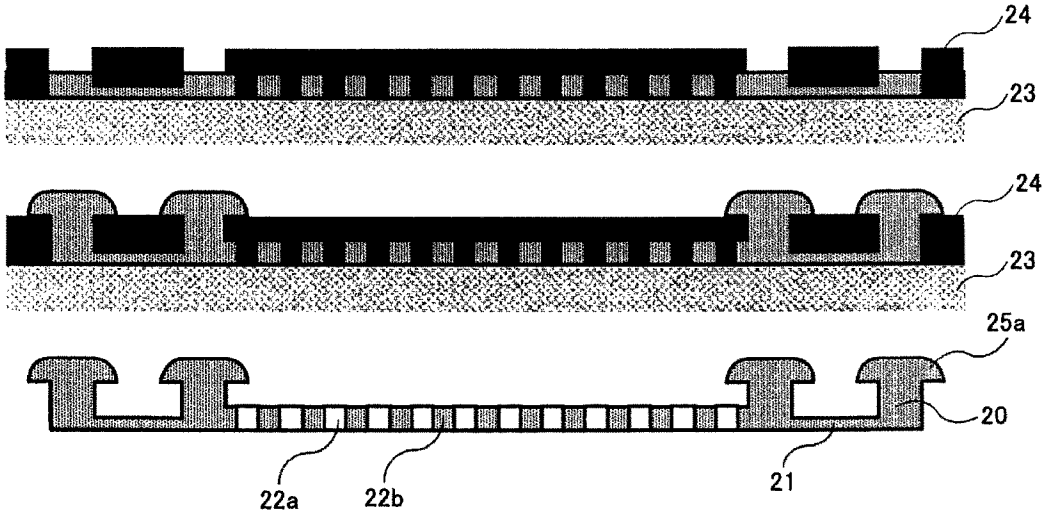

In the present embodiment, thickened parts that are thicker than the filter part 22 are formed at the nozzle alignment direction side end portions of the filter plate 20, and the top portions of the thickened parts are arranged into overhanging portions 25*a* as is shown in FIG. 8G.

The filter plate 20 as is shown in FIG. 8G may be fabricated by performing electroforming processes on the substrate 23 having the resist 24 applied thereon as is shown in FIGS. 8A-8F.

In the process step shown in FIG. 8F, the electroformed part that is to be the filter plate 20 is arranged to be thicker than the resist 24. In this way, the overhanging portions 25*a* may be created at the top portions of the thickened parts.

Figure 9A:
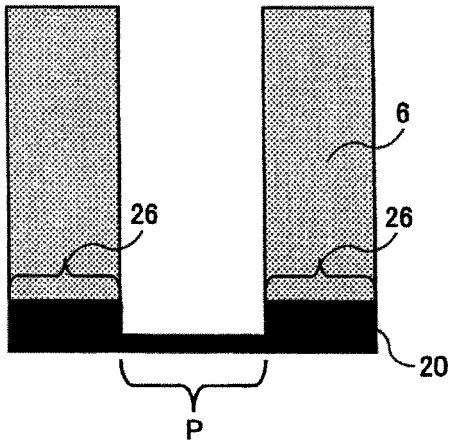
FIGS. 9A-9B are cross-sectional views of exemplary connections between the filter plate and a frame.
Figure 9B:
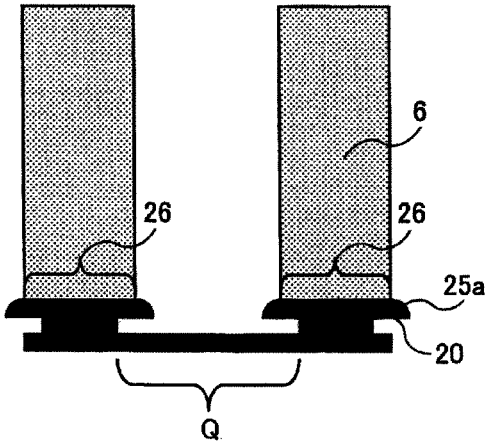

FIGS. 9A-9B are partial views of exemplary connections between the filter plate 20 and the frame 6.

FIG. 9A shows an example using the filter plate 20 fabricated by the process steps shown in FIGS. 6A-6G. FIG. 9B shows an example using the filter plate 20 having the overhanging portions 25*a* fabricated by the process steps shown in FIGS. 8A-8G. It is noted that P and Q in FIGS. 9A and 9B represent areas secured for the filter part 22 or the damper part 21. Also, in FIGS. 9A and 9B, connection areas 26 are secured when connecting the filter plate 20 to the frame 6.

In the example shown in FIG. 9B, the connection areas 26 may be secured for connecting the filter plate 20 to the frame 6, and the area Q secured for the filter part 22 or the damper part 21 may be greater than the area P secured for the filter part 22 or the damper part 21 in the example of FIG. 9A.

Figure 10:
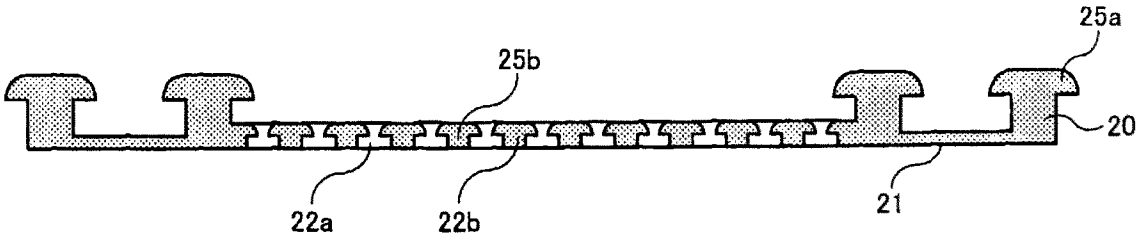
FIG. 10 is a cross-sectional view of the filter plate according to another embodiment.

FIG. 10 shows the filter plate 20 according to another embodiment in which the top portions of the filter member 22*b* forming the filter holes 22*a* is also arranged to have overhanging portions 25*b*.

Figure 11:
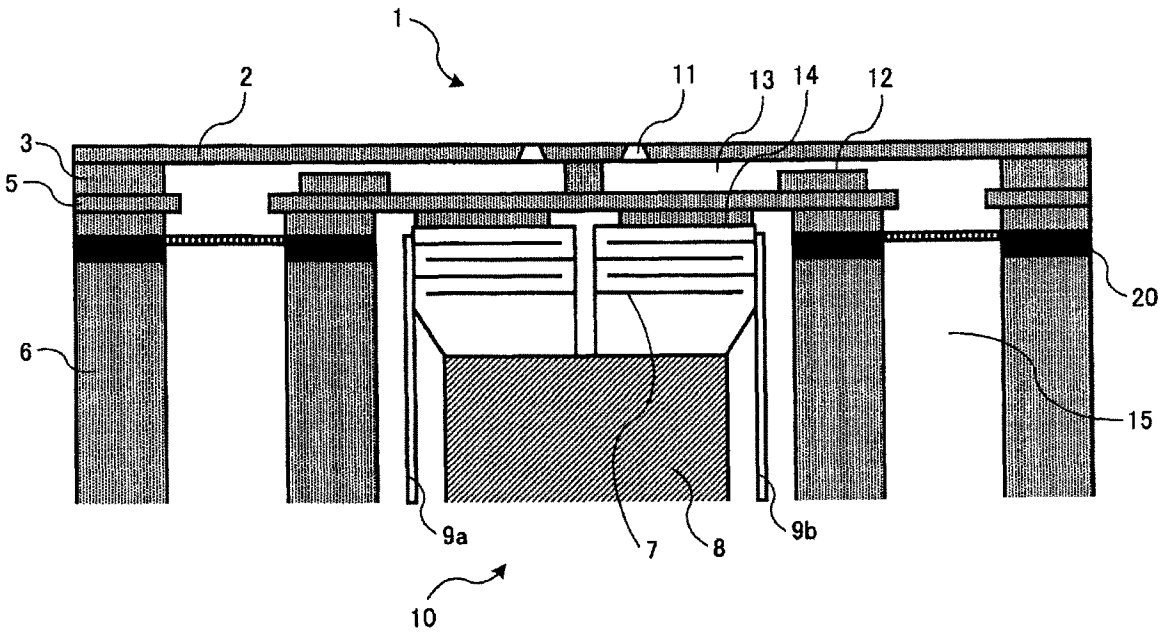
FIG. 11 is a cross-sectional view of the liquid discharge head according to another embodiment.

FIG. 11 is a cross-sectional view of a liquid discharge head 1 according to another embodiment of the present invention.

As is shown in FIG. 11, the liquid discharge head 1 includes a nozzle plate 2 that has nozzles 11 arranged into two rows; a flow path plate 3 that forms fluid resistance parts 12, ink flow paths, and the individual liquid chambers 13; the oscillating plate 5 having a concave part 14; the frame 6 having the common liquid chamber 15; two sets of the piezoelectric elements 7; the base member 8; and an actuator unit 10 including two sets of power supply members 9*a*, 9*b*, which may be made of flexible printed circuits (FPC), for example. The filter plate 20 including the filter part 22 and the damper part 21 is arranged at a liquid flow path between the common liquid chamber 15 and the individual liquid chambers 13.

The nozzle plate 2 may be fabricated by an electroforming process using nickel or by pressing a stainless steel plate, for example. The flow path plate 3 may be a single member created by etching silicon or a stainless press plate arranged into a laminated layer structure or a single layer structure, for example. The oscillating plate 5 may be an electroformed part made of nickel or a laminated layer structure made of stainless steel and polyimide, for example.

By transmitting a control signal to the piezoelectric elements 7 via the power supply members 9*a*, 9*b*, the oscillation plate 5 may be deformed to change the volume of the individual liquid chambers 13 so that liquid droplets may be individually discharged from the nozzles 11 of the nozzle plate 2.

In the following, the liquid discharge head 1 according to another embodiment is described with reference to FIGS. 12 and 13.

Figure 12:
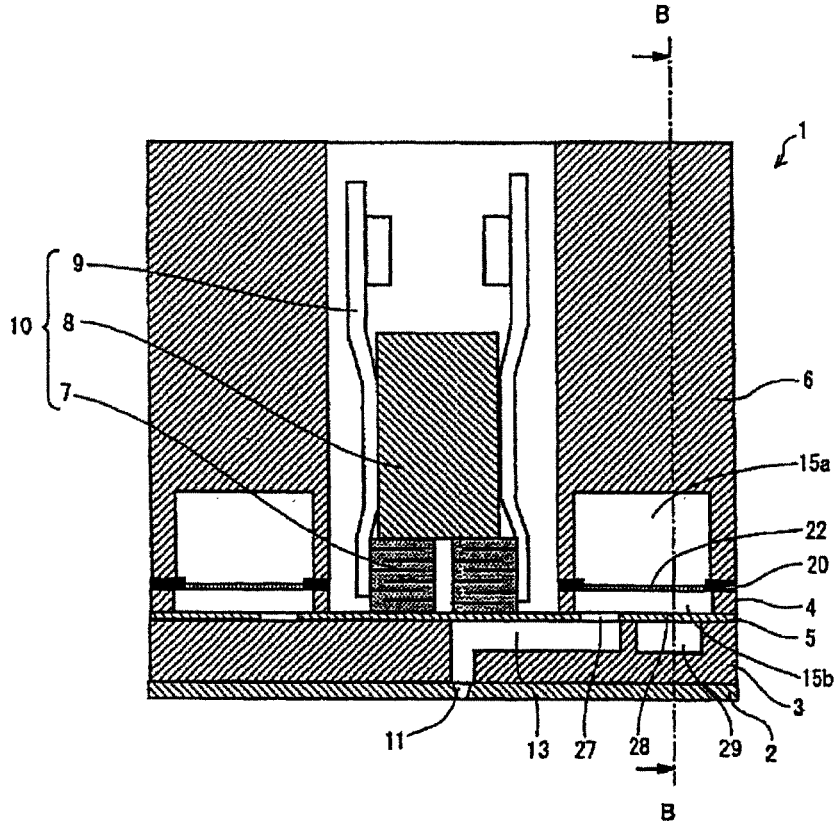
FIG. 12 is a cross-sectional view of the liquid discharge head according to another embodiment.

FIG. 12 is a cross-sectional view of the liquid discharge head 1 according to the present embodiment across a direction perpendicular to the nozzle alignment direction. It is noted that features of the present embodiment that are identical to those of the previously described embodiment are given the same reference numerals and their descriptions are omitted.

In the present embodiment, the common liquid chamber 15 includes an above-filter common liquid chamber 15*a* that is arranged at the upstream side of the filter plate 20 and a below-filter common liquid chamber 15*b* that is arranged at the downstream side of the filter plate 20. Part of the oscillating plate 5 forming a wall of the below-filter common liquid chamber 15*b* is arranged into a deformable region (damper region) 28, and the flow path plate 3 forms a damper chamber (oscillating plate damper chamber) 29 at the other side of the damper region 28 of the oscillating plate 5 opposite the below-filter common liquid chamber 15*b*.

The oscillating plate 5 also forms a liquid supply path 27 that is arranged to be a communication path between the below-filter common liquid chamber 15*b* and the individual liquid chambers 13. Further, at the opposite side of the oscillating plate 5 opposing the individual liquid chambers 13, a second common liquid chamber member 4 that also acts as a damper chamber member, the filter plate 20 including the filter part 22 and the damper part 21, and a first common liquid chamber member 6 that also acts as the frame of the liquid discharge head 1 are successively laminated and bonded with adhesive. In this way, the above-filter common liquid chamber 15*a* and the below-filter common liquid chamber 15*b* are formed by the first common liquid chamber member 6 and the second common liquid chamber member 4.

Figure 13:
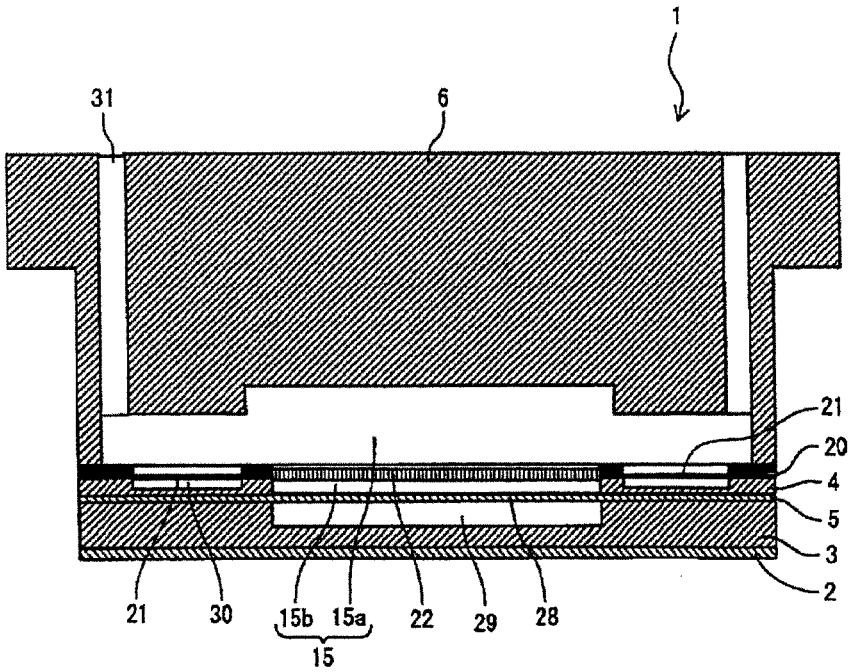
FIG. 13 is a cross-sectional view of the liquid discharge head from section B-B of FIG. 12.

FIG. 13 is a cross-sectional view of section B-B of FIG. 12. The filter plate 20 includes the filter part 22 that has plural filter holes 22*a* and the damper part 21 that is thinner than the filter part 22 arranged at the two nozzle alignment direction side ends of the filter plate 20.

The second common liquid chamber member 4 forms a damper chamber (second common liquid chamber member damper chamber) 30 at one side of the damper part 21 opposite the above-filter common liquid chamber 15*a*. It is noted that the damper chamber 30 is arranged to be in communication with the atmosphere via an atmosphere communication path not shown).

The first common liquid chamber member 6 includes liquid supply parts 31 for supplying liquid to the liquid discharge head 1 from the exterior. The liquid supply parts 31 are arranged at the longitudinal side edges of the above-filter common liquid chamber 15*a* and are arranged at the nozzle alignment direction side end portions of the damper part 21.

In the following, the filter plate 20 according to another embodiment is described with reference to FIGS. 14 and 15.

Figure 14:
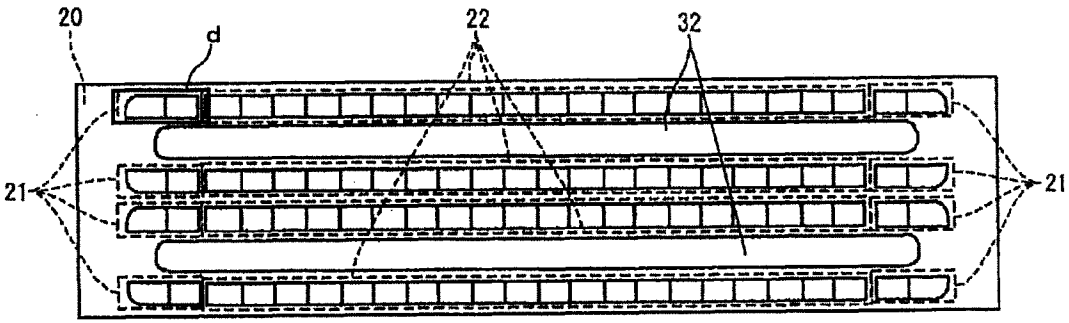
FIG. 14 is a plan view of the filter plate according to another embodiment.
Figures 15A, 15B:
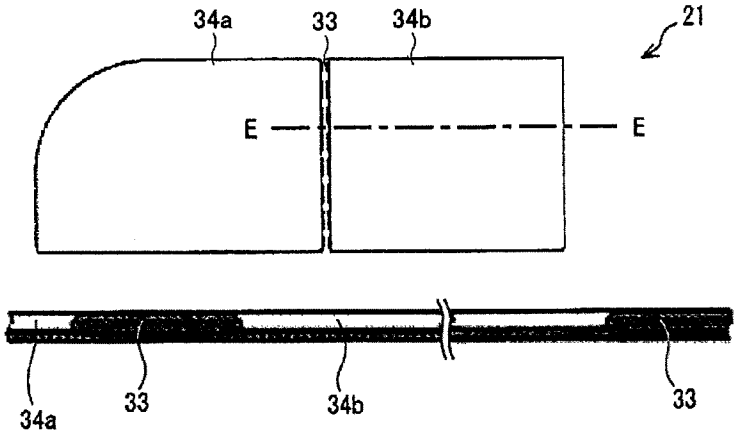
FIGS. 15A-15B are partial views of the damper part of the filter plate shown in FIG. 14.

FIG. 14 is a plan view of the filter plate 20 according to the present embodiment; FIG. 15A is an enlarged view of the damper part 21 that is encircled by a solid line d in FIG. 14; and FIG. 15B is a cross-sectional view of section E-E of FIG. 15A.

In the present embodiment, the filter plate 20 has nozzles arranged into four rows. The filter plate 20 also has four rows of the filter part 22 and the damper part 21 aligned in the nozzle alignment direction. Further, the filter plate 20 has through holes 32 for arranging the actuator unit 10.

The filter plate 20 according to the present embodiment has portions (ribs 33) that are thicker than the filter part 22 arranged in the nozzle alignment direction to divide the filter part 22 and the damper part 21 into plural regions. In FIG. 15B, the damper part 21 is divided into two regions 34*a*, 34*b* by the rib 33. It is noted that the damper part region that is located at the nozzle alignment direction side end (region 34*a*) is arranged into an R-shape as is shown in FIG. 15A.

The filter part 22 is also divided into plural filter regions by the ribs 33 in a similar manner. In the exemplary structure shown in FIG. 14, each nozzle row is divided into 20 filter regions.

It is noted that although the nozzles are arranged into four rows in the above embodiment, the ribs 33 may be used to divide the damper part 21 and the filter part 22 into plural regions in the liquid discharge head 1 having two nozzle rows as well.

In the following, image forming apparatuses according to embodiments of the present invention are described with reference to FIGS. 16-18.

Figure 16:
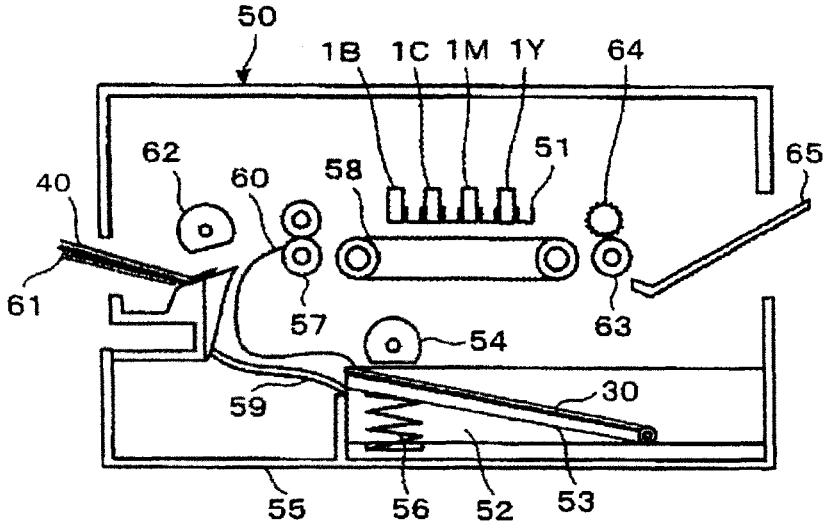
FIG. 16 is a cross-sectional view of an image forming apparatus according to an embodiment of the present invention.

FIG. 16 is a cross-sectional view of a mechanical part of an image forming apparatus 50 according to an embodiment of the present invention.

The image forming apparatus 50 includes liquid discharge heads 1B, 1C, 1M, and 1Y that discharge liquid droplets in the colors black (B), cyan (C), magenta (M), and yellow (Y) (collectively referred to as "liquid discharge head 1" hereinafter). The liquid discharge head 1 has a maintenance unit 51 that moves to face opposite the nozzle face of the liquid discharge head 1 upon performing maintenance operations such as a purging process or a wiping process, for example.

The liquid discharge head 1 used in the present embodiment corresponds to a line-type liquid discharge head that has nozzle rows extending across a length at least as long as the recording region width of the recording medium. The image forming apparatus 50 has a paper feed tray 52 that includes a pressure plate 53 and a paper feed rotating unit 54 for feeding recording paper (recording medium) 40 arranged at a base 55. The pressure plate 53 is arranged to rotate around a rotational axis at the base 55 and is pressed against the paper feed rotating unit 54 by a pressure plate spring 56. It is noted that a separation pad (not shown) made of a material with a high frictional coefficient such as artificial leather is arranged on the pressure plate 53 opposite the paper feed rotating unit 54 in order to prevent more than one sheet of recording paper 40 from being fed into the image forming apparatus 50. Also, the paper feed tray 52 includes a release cam (not shown) for releasing the contact between the pressure plate 53 and the paper feed rotating unit 54.

In the following, operations of the image forming apparatus 50 are described.

When the image forming apparatus 50 is in standby mode, the release cam presses the pressure plate 53 to a predetermined position. In this way, the contact between the pressure plate 53 and the paper feed rotating unit 54 may be released. When a drive force of a transporting roller 57 is transmitted to the paper feed rotating unit 54 and the release cam by a gear, for example, the release cam may move away from the pressure plate 53 and the pressure plate 53 may come into contact with the paper feed rotating unit 54. With the rotation of the paper feed rotating unit 54, the recording paper 40 on the pressure plate 53 may be picked up and paper feed operations may be started. The recording paper 40 may be fed one sheet at a time by a separator (not shown). The paper feed rotating unit 54 is rotated to send the recording paper 40 to a platen 58. The recording paper 40 passes through guides 59, 60 to be guided to a transport roller 57 and is then transported to the platen 58. Then, the image forming apparatus 50 returns to standby mode in which the contact between the recording paper 40 and the paper feed rotating unit 54 is released and the drive force from the transport roller 57 is cut off.

The recording paper 40 may also be fed via a manual feed tray 61 in which case the recording paper 40 is transported by a paper feed rotating unit 62 to the transport roller 57 and then to the platen 58. The recording paper 40 transported to the platen 59 may have a desired image formed thereon by the liquid discharge heads 1B, 1C, 1M, and 1Y based on a control signal that controls the paper transporting speed and liquid discharge timing. The recording paper 40 having the desired image recorded thereon is then transported by a paper delivery roller 63 and a spur 64 to be delivered to the paper delivery tray 65.

As can be appreciated, by using the liquid discharge heads 1B, 1C, 1M, and 1Y corresponding to line-type liquid discharge heads, a desired image may be swiftly formed on the recording paper 40.

Figure 17:
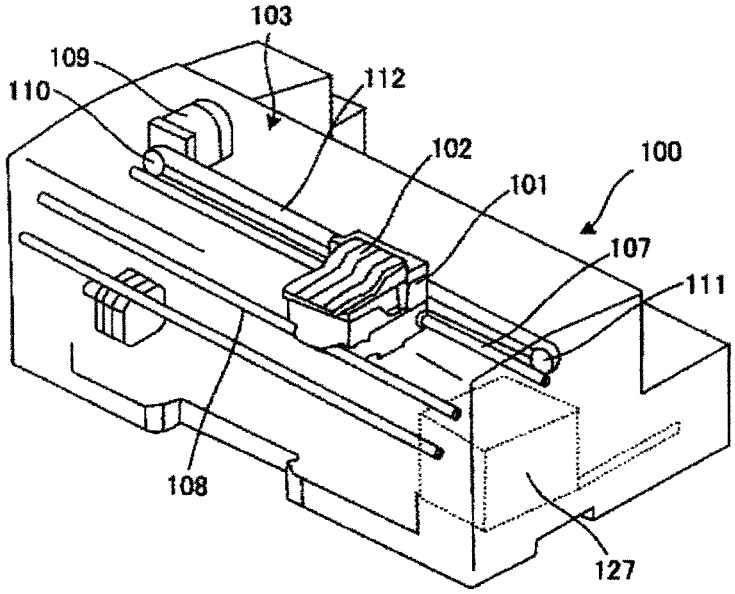
FIG. 17 is a perspective view of an image forming apparatus according to another embodiment.
Figure 18:
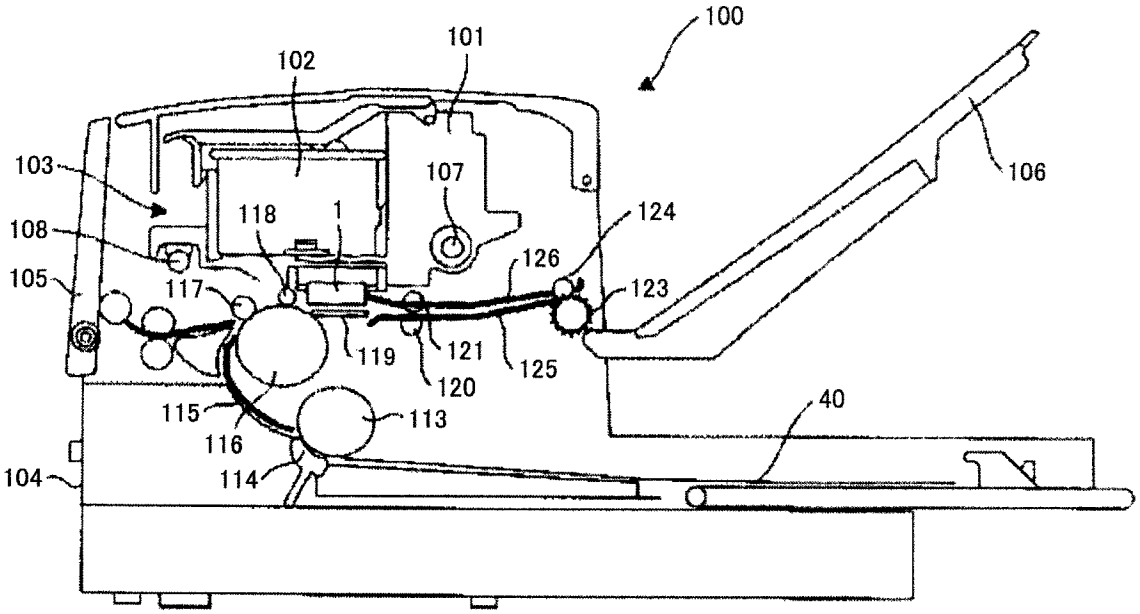
FIG. 18 is a cross-sectional view of the image forming apparatus shown in FIG. 17.

FIG. 17 is a perspective view of an image forming apparatus 100 according to another embodiment of the present invention. FIG. 18 is a cross-sectional view of the image forming apparatus 100.

The image forming apparatus 100 includes a printing mechanism 103 that has a carriage 101 that may be moved back and forth in the main scanning direction inside the apparatus main frame, liquid discharge heads 1 that are loaded in the carriage 101, and ink cartridges 102 that supply ink to the liquid discharge heads 1. The image forming apparatus 100 also has a paper feed cassette (or paper feed tray) 104 detachably arranged at the lower side of the apparatus main frame. The paper feed cassette 104 is configured to accommodate plural sheets of recording paper 40 that may be stacked from the front side.

The image forming apparatus 100 also has a manual paper feed tray 105 that may be opened to manually feed the recording paper 40. The recording paper 40 that is fed from the paper feed cassette 104 or the manual paper feed tray 105 is transported to the printing mechanism 103, and after a desired image is formed on the recording medium 30 by the printing mechanism, the recording paper 40 is delivered to a delivery tray 106 that is arranged at the rear side of the image forming apparatus 100.

The printing mechanism 103 has a main guide rod 107 and a sub guide rod 108 that are suspended across left and right side walls (not shown) to slidably hold the carriage 101 and enable the carriage 101 to move back and forth in the main scanning direction. The carriage 101 loads the liquid discharge heads 1 so that ink may be discharged in a downward direction. The liquid discharge heads 1 discharge ink droplets in the colors yellow (Y), cyan (C), magenta (M), and black (Bk), and has plural ink discharge openings (nozzles) arranged in a direction intersecting the main scanning direction. The carriage 101 also loads replaceable ink cartridges 102 for supplying ink in the above colors to the liquid discharge heads 1.

The ink cartridges 102 include atmospheric openings arranged at the upper side for communicating with the atmosphere, supply openings arranged at the lower side for supplying ink to the liquid discharge heads 1, and porous materials arranged in the interior for holding the ink to be supplied to the liquid discharge heads 1. The ink to be supplied to the liquid discharge heads 1 are maintained at a slightly negative pressure by the capillary force of the porous materials.

It is noted that although plural liquid discharge heads 1 that discharge ink in different colors are used in the present embodiment, in other embodiments, one liquid discharge head 1 that is configured to discharge ink droplets in different colors may be used.

The carriage 101 has a rear side (paper transporting direction downstream side) slidably engaging the main guide rod 107, and a front side (paper transporting direction upstream side) slidably mounted on the sub guide rod 108. A timing belt 112 that is wound around a drive pulley 110 that is driven by a main scanning motor 109 and a driven pulley 111 is fixed to the carriage 101 in order to move the carriage 101 in the main scanning direction. The carriage 101 is moved back and forth in the main scanning direction by forward and reverse rotations of the main scanning motor 109.

In order to transport the recording paper 40 that is set to the paper feed cassette 104 to a position beneath the liquid discharge heads 1, the image forming apparatus 100 includes a paper feed roller 113 and a friction pad 114 that separates the recording paper 40 introduced from the paper feed cassette 104 and feeds the recording paper 40 one sheet at a time, a guide member 115 that guides the recording paper 40, a transport roller 116 that reverses the recording paper 40 and transports the recording paper 40 to a print receiving member 119, a transport collar 117 that is pressed against the peripheral face of the transport roller 116, and a tip collar 118 that regulates the transporting angle of the recording paper 40. The transport roller 116 is rotated by a sub scanning motor via a gear row not shown).

The print receiving member 119 is arranged beneath the recording heads 1 and acts as a paper guide member for guiding the recording paper 40 transported by the transport roller 116 according to the main scanning direction moving range of the carriage 101. At the paper transport direction downstream side of the print receiving member 119, a transport collar 120 and a spur 121 that are rotated to transport the recording paper 40 in the paper delivery direction, a paper delivery roller 123 and a spur 124 for delivering the recording paper 40 to the paper delivery tray 106, and guide members 125, 126 that form a paper delivery path are arranged.

The image forming apparatus 100 may record an image on the recording paper 40 by moving the carriage 101 and driving the liquid discharge heads 1 according to an image signal so that ink may be discharged from the recording heads 1 to record one line image while the recording paper 40 is at a standstill, and then transporting the recording paper 40 by a predetermined amount to record the next line image.

Upon receiving a recording end signal or a signal indicating that the end of the recording region of the recording paper 40 has been reached, the recording operations are ended and the recording paper 40 is transported and delivered to the paper delivery tray 106.

The image forming apparatus 100 also has a restoration unit 127 for restoring the liquid discharge heads 1 arranged at the right side of the carriage moving direction outside the recording region.

The restoration unit 127 includes a capping means and a cleaning means. During print standby mode, the carriage 101 is moved to the restoration unit 127 and the liquid discharge heads 1 are capped by the capping means to retain moisture at the discharge openings and prevent discharge defects due to the drying of ink.

Also, during recording operations, ink unrelated to the recording operations may be discharged so that a uniform ink viscosity may be maintained at the discharge openings and stable discharge performance may be ensured.

Further, in a case where discharge defects occur, for example, the liquid discharge heads 1 may be restored by sealing the discharge openings (nozzles) of the liquid discharge heads 1 with the capping means, sucking out ink and air bubbles from the discharge openings with suction means via tubes, and removing ink and dust adhered to the discharge opening surfaces with the cleaning means.

The ink sucked out of the discharge openings is discharged to a waste ink reserve (not shown) that is arranged at the lower part of the apparatus main frame and is absorbed and retained by an ink absorbing material arranged inside the waste ink reserve.

According to an aspect of the present embodiment, by using the liquid discharge head 1 including the actuator unit 10 in the image forming apparatus 100, stable ink droplet discharge characteristics may be obtained and the image quality may be improved, for example.

It is noted that although the above embodiments relate to the application of the liquid discharge head 1 in the image forming apparatuses 50 and 100, the present invention is not limited to liquid discharge heads and apparatuses that discharge ink droplets. For example, a liquid discharge head according an embodiment of the present invention may be used in an apparatus that discharges a resist material for forming a resist pattern.

Further, the present invention is not limited to these embodiments, and numerous variations and modifications may be made without departing from the scope of the present invention.

The present application is based on and claims the benefit of the priority dates of Japanese Patent Application Nos. 2011-272044 and 2012-224742 filed on Dec. 13, 2011 and Oct. 10, 2012, respectively, the entire contents of which are hereby incorporated by reference.

What is claimed is:

1. A liquid discharge head comprising:

plural nozzles arranged in a nozzle alignment direction, a nozzle amongst the plural nozzles being configured to discharge liquid droplets in a liquid discharge direction;

a common liquid chamber that supplies liquid to an individual liquid chamber that is in communication with the nozzle; and a filter plate that is arranged in a liquid flow path of the common liquid chamber and filters the liquid that passes in a liquid flow path direction through the filter plate, the filter plate including a filter hole arrangement portion that includes plural filter holes and has a thickness in a thickness direction parallel to the liquid flow path direction, and a damper wall that does not include any of the filter holes and that reduces a pressure variation in the common liquid chamber; wherein a thickness of the damper wall of the filter plate in the thickness direction is thinner than that of the filter hole arrangement portion of the filter plate.

2. The liquid discharge head as claimed in claim 1, wherein the damper wall is arranged at both sides of the filter hole arrangement portion of the filter plate, in the nozzle alignment direction.

3. An image forming apparatus comprising the liquid discharge head of claim 1.

4. The liquid discharge head as claimed in claim 1, wherein the damper wall is arranged into a quadrangle shape in planar view with a long side and a short side having substantially a same length.

5. The liquid discharge head as claimed in claim 1, wherein the damper wall includes, in a plan view in the liquid discharge direction, a rectangular region and an R-shape region with one corner portion of the R-shape region being rounded in said plan view.

6. The liquid discharge head as claimed in claim 5, wherein the rectangular region and the R-shape region are divided by a rib oriented in the liquid discharge direction having a thickness thicker than that of the filter hole arrangement portion of the filter plate.

7. The liquid discharge head as claimed in claim 1, wherein the filter plate includes another part that is arranged at a nozzle alignment direction side edge portion of the filter plate and includes a top portion that is arranged into an overhanging portion.

8. The liquid discharge head as claimed in claim 1, wherein the common liquid chamber includes:

an above-filter portion that is disposed upstream of the filter plate in the liquid flow path direction; and a below-filter portion that is disposed downstream of the filter plate in the liquid flow path direction, wherein a damper wall member forming the damper wall additionally forms a part of a wall face of the above-filter portion of the common liquid chamber, and wherein the liquid discharge head further comprises a common liquid chamber member in which a damper chamber and the below-filter portion of the common liquid chamber are arranged, and wherein the damper chamber faces the damper wall.

* * * * *